US006190174B1

(12) United States Patent
Lam

(10) Patent No.: US 6,190,174 B1
(45) Date of Patent: Feb. 20, 2001

(54) ELECTRONIC STORY BOARD

(75) Inventor: Chi-Ming Lam, Kowloon (HK)

(73) Assignee: Kader Industrial Company Limited, Hong Kong (CN)

( * ) Notice: Under 35 U.S.C. 154(b), the term of this patent shall be extended for 0 days.

(21) Appl. No.: 09/324,679

(22) Filed: Jun. 3, 1999

(51) Int. Cl.[7] ..... G09B 5/00

(52) U.S. Cl. ..... 434/169; 434/128; 434/365; 463/43; 463/39; 273/237

(58) Field of Search ..... 434/118, 128, 434/156, 169, 178, 185, 201, 307 R, 308, 322, 323, 362, 365; 463/9, 36, 43, 39; 273/237, 429, 432; 446/297; 700/90, 92; 178/18.03, 19.01; 345/4, 114, 153, 178

(56) References Cited

U.S. PATENT DOCUMENTS 4,492,581 * 1/1985 Arai et al. ..... 434/128
4,710,873 * 12/1987 Breslow et al. ..... 463/31
4,776,593 * 10/1988 DiPersio et al. ..... 463/43
4,840,382 * 6/1989 Rubin ..... 463/9
5,127,869 * 7/1992 Hanzawa ..... 446/397
5,188,533 * 2/1993 Wood ..... 434/169
5,190,285 * 3/1993 Levy et al. ..... 463/36
5,261,820 * 11/1993 Slye et al. ..... 463/1
5,377,997 * 1/1995 Wilden et al. ..... 463/43
5,423,554 * 6/1995 Davis ..... 463/4
5,433,610 * 7/1995 Godfrey et al. ..... 434/169
5,648,999 * 7/1997 Easterling et al. ..... 455/412
5,823,782 * 10/1998 Marcus et al. ..... 434/156
5,853,327 * 12/1998 Gilboa ..... 463/39
5,865,624 * 2/1999 Hayashigawa ..... 434/66
5,877,458 * 3/1999 Flowers ..... 178/18.01

* cited by examiner

*Primary Examiner*—Joe H. Cheng
(74) *Attorney, Agent, or Firm*—Alix, Yale & Ristas, LLP

(57) ABSTRACT

An interactive toy employs a plurality of figures which are employed by the user to tell a story. The figures are selected and placed at selected locations on a story board or a book. The selection and placement results in the device telling the story by synthesized speech and other visual communications. The device is also configured in a compact case for carrying and storage.

20 Claims, 9 Drawing Sheets

ELECTRONIC STORY BOARD

BACKGROUND OF THE INVENTION

This invention relates generally to electronic toys. More particularly, this invention relates to educational toys wherein the user's interaction with the toy is facilitated by electronic processing and communication.

In toys to which the invention relates, the user, through manual manipulation, voice command or other techniques, provides an input. The toy is programmed to provide an output in response to the input of the user. The usage of microcomputers and speech synthesizers has found widespread application in conjunction with numerous toys, games and educational devices of various forms.

SUMMARY OF THE INVENTION

Briefly stated, the invention in a preferred form is an interactive toy which tells a story in a creative and interesting fashion. A platform supports a story board which may take the form of an illustrated sheet, a page of a book or other similar media. A CPU is mounted in fixed relationship to the platform. An output device, which "tells" the story, communicates with the CPU. A plurality of readers, each of which communicate with the CPU, comprises an RF transmitter which defines a communication field and is mounted at a fixed position to the platform. Story figures, each comprising a transponder and having a unique electronic code, are placeable at selected locations of the story board. Upon placement of at least one story figure within a field, an output is produced by the output device. The output is a function of the code and corresponding reader of each placed figure.

The output device may take a number of forms including a speaker, which broadcasts synthesized speech narrating the story, noise, sounds or other audibly perceptible outputs, one or more lights and an action module. The story figures comprise one or more representational figures selected from the group consisting of a person, an animal, a tree and an object. The electronic story board may be configured in a case which houses the story figures and is hinged. Outer panels of the case form the platform to which an illustrated sheet or a story book may be placed. The action module may be mounted to the platform and project generally above the story board.

The CPU sequentially polls each of the readers and identifies any story figure which is placed at a corresponding station on the story board. Each of the readers is polled, and a responsive output is then generated to partially narrate or illustrate the story by sound, sight or movement.

An object of the invention is to provide a new and improved electronic story board wherein interaction between the user and the board is accomplished in a creative and entertaining manner.

Another object of the invention is to provide a new and improved electronic story board which provides an educational interaction with the user to facilitate appreciation and enjoyment of a story.

A further object of the invention is to provide a new and improved electronic toy which is capable of providing a multiplicity of sensory outputs in response to a creative method of personal inquiry by the user.

Other objects and advantages of the invention will become apparent from the specification and the drawings.

DETAILED DESCRIPTION OF THE PREFERRED EMBODIMENTS

Figure 1:
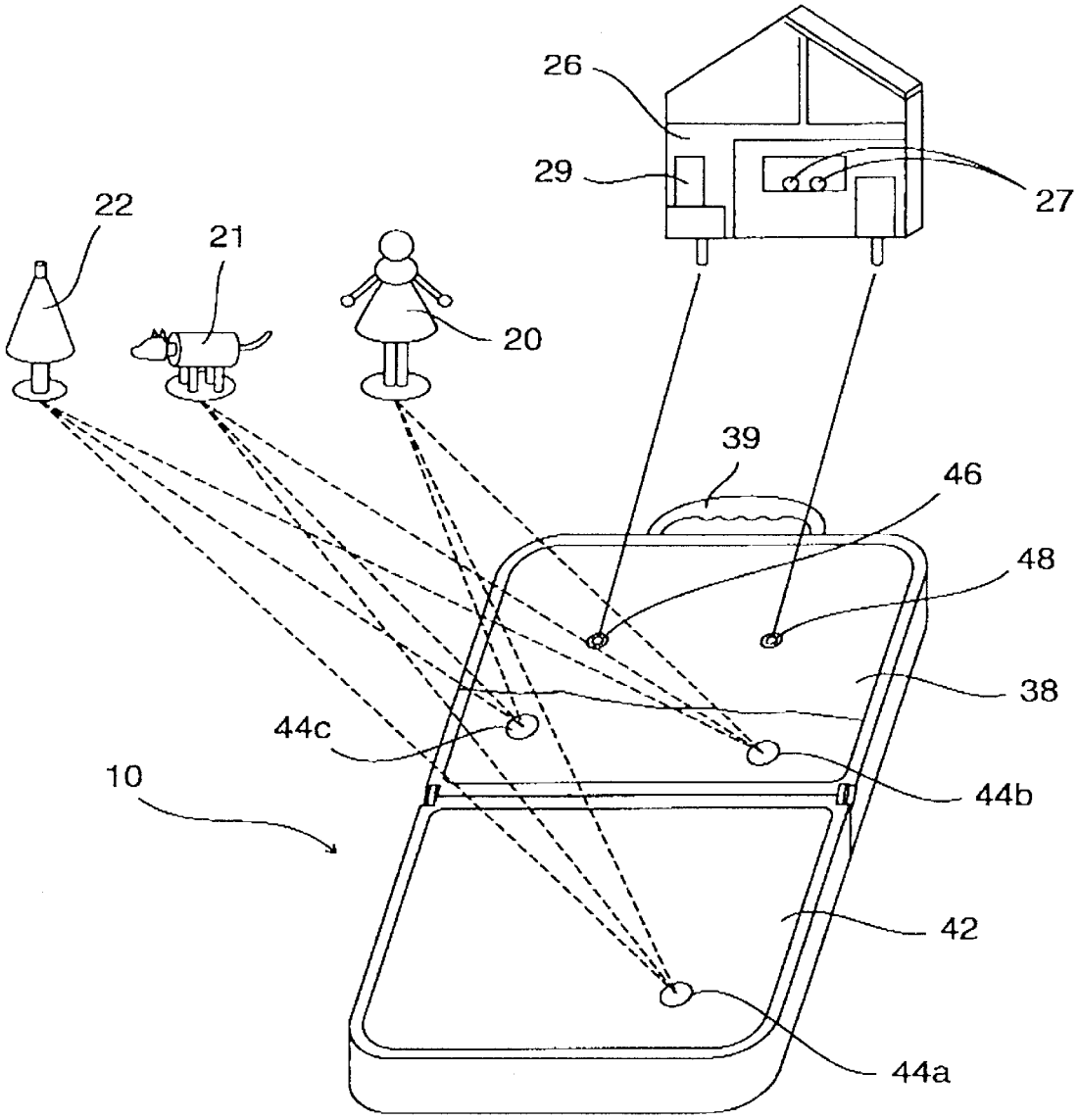
FIG. 1 is a schematic representational view, partly in phantom, illustrating a representative electronic story board and its usage in accordance with the present invention.
Figure 2:
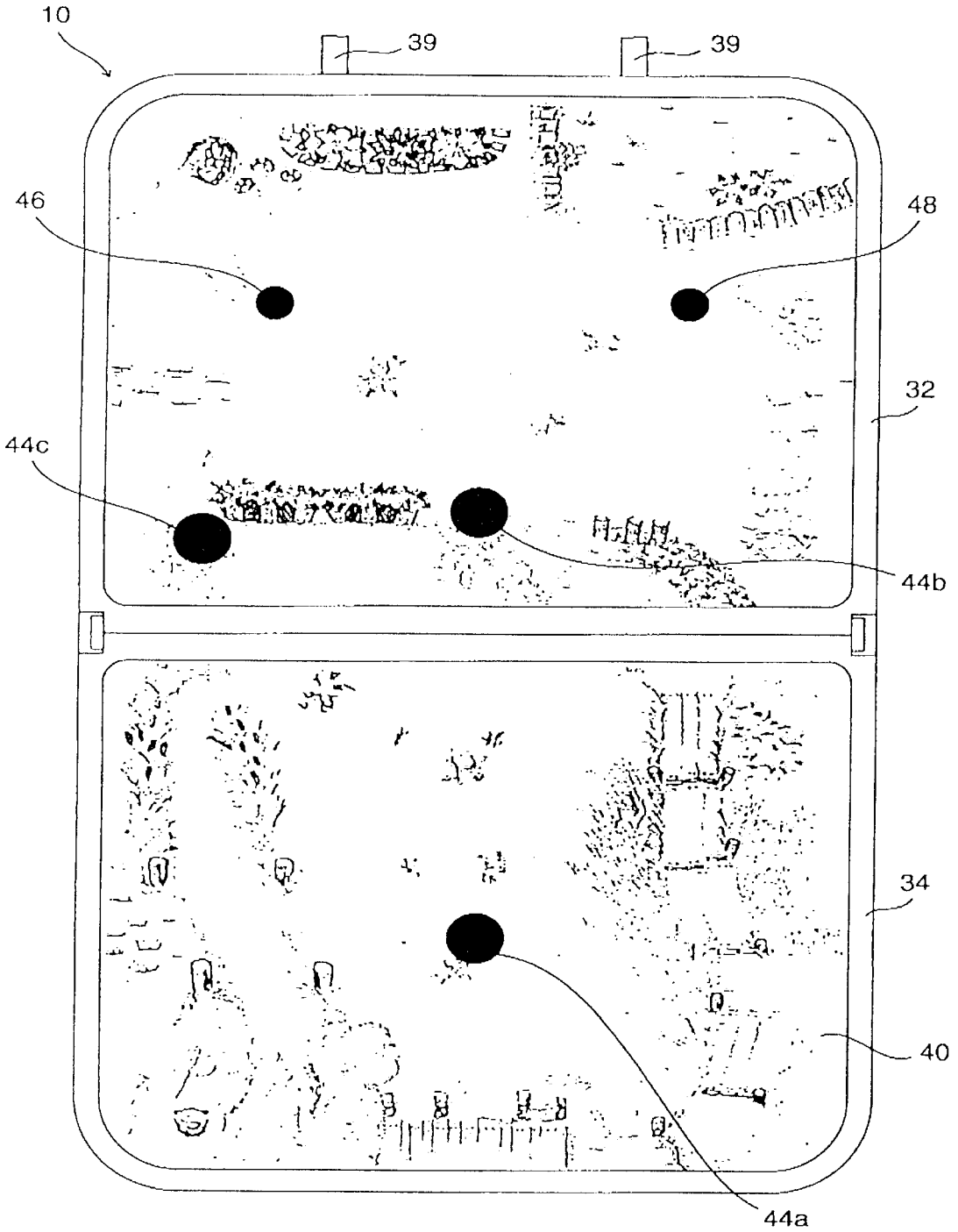
FIG. 2 is a top plan view of a representative electronic story board in accordance with the present invention.
Figure 4:
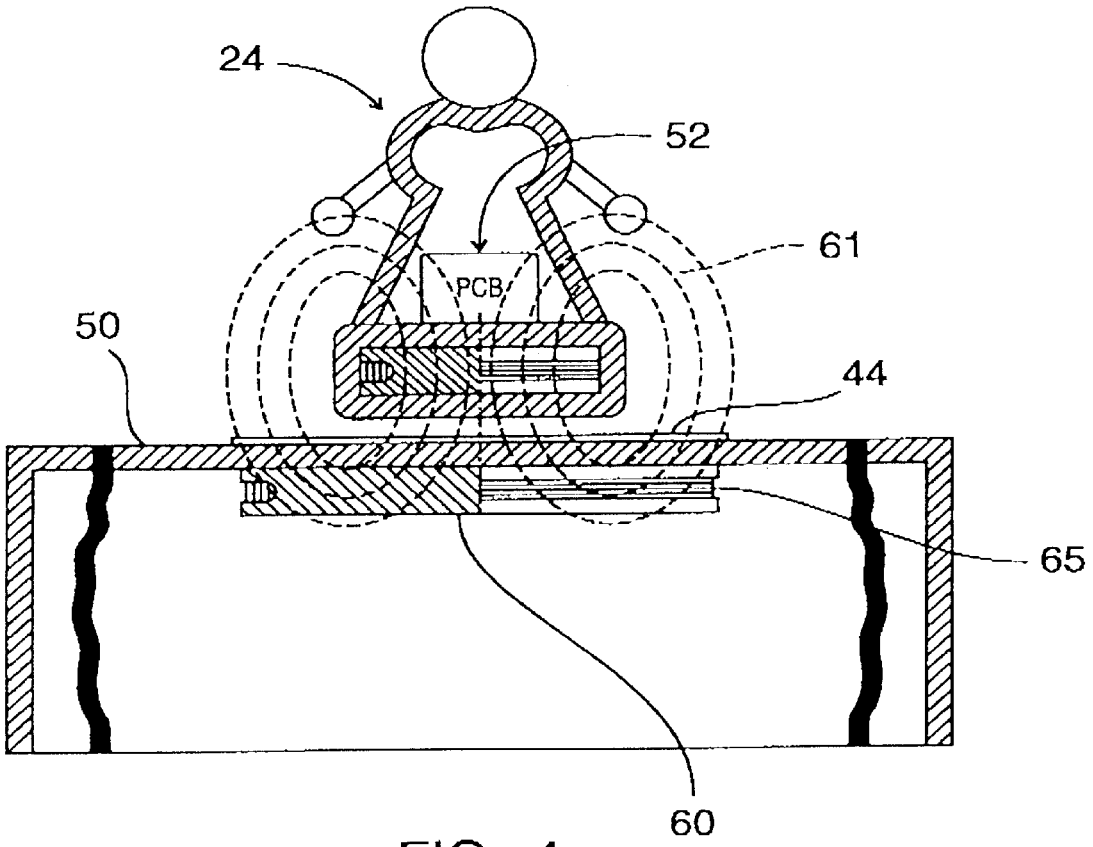
FIG. 4 is an enlarged elevational view, partly broken away, partly in section and partly in schematic, of a toy figure mounted to the electronic story board, partially illustrated, of FIG. 1.
Figure 5:
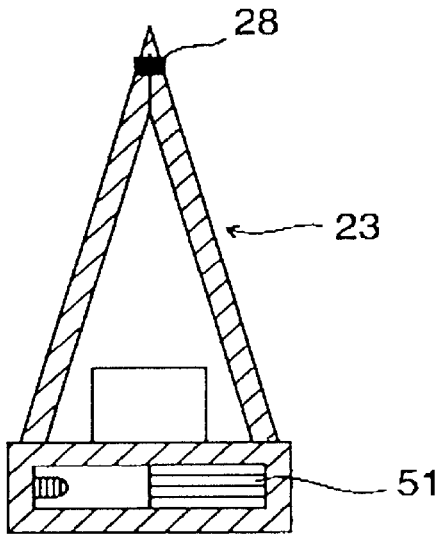
FIG. 5 is an enlarged elevational view, partly broken away, partly in section and partly in schematic, illustrating a second form of a toy figure for the electronic story board of FIG. 1.
Figure 6:
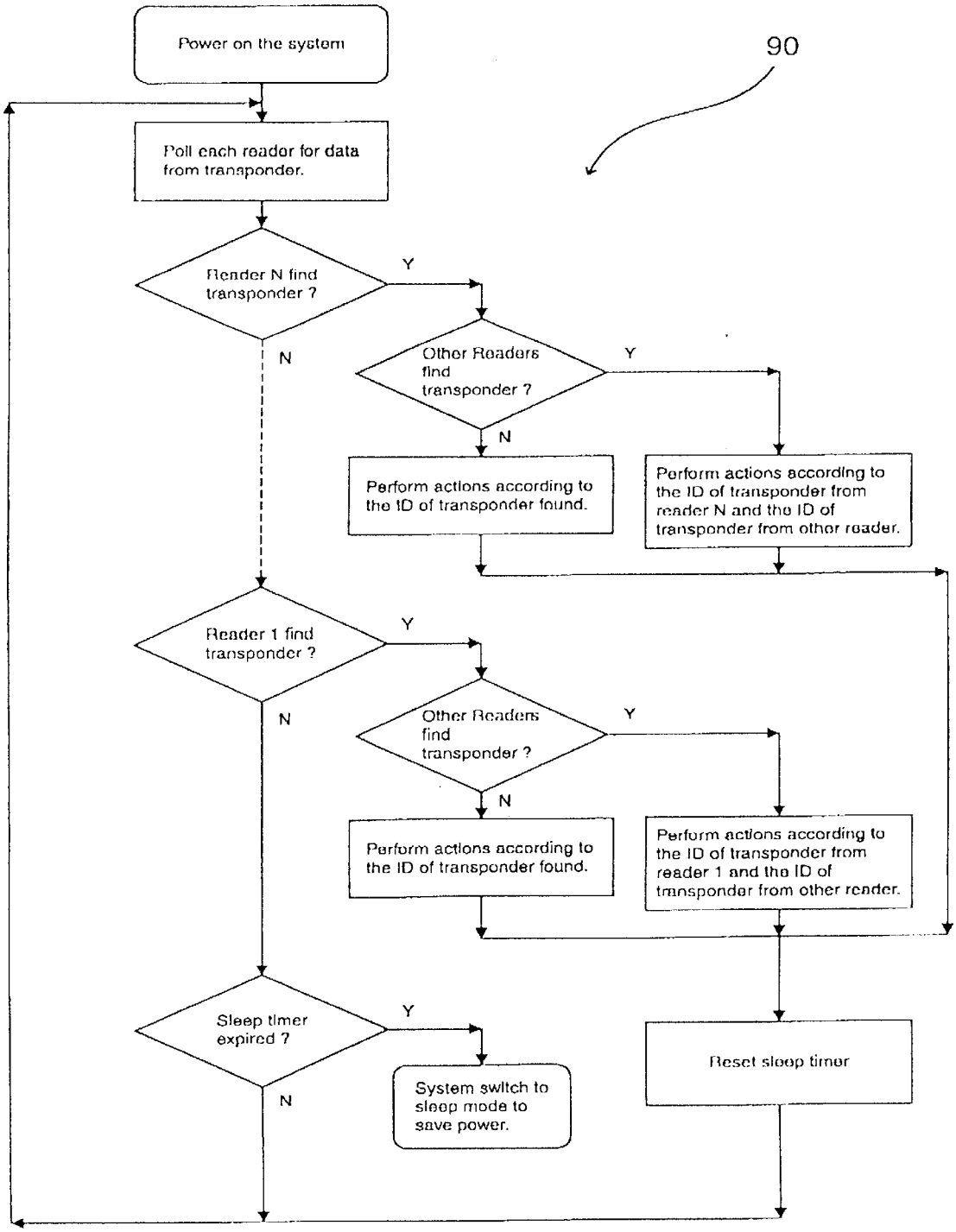
FIG. 6 is a flow chart illustrating the processing performed by the electronic story board of FIG. 1.

With reference to the drawings, wherein like numerals represent like parts throughout the figures, an electronic story board in accordance with the present invention is generally designated by the numeral 10. The electronic story board 10 functions to communicate a story through sound, light, motion and sensory outputs in response to the selection and placement of one or more toy figures 20–24 (FIGS. 1, 4 and 5). An output module 26 is optionally employed to aid in the "telling" of the story. The figures and the module are intended to be representational of numerous possibilities of figures and modules that may be employed according to the specific story.

The electronic story board is preferably packaged in a compact case 30 (FIG. 3) which ho uses the electronic circuitry and components, as will be further described, as well as functions as a carrying case for the toy figures 20–24 and output module 26. The case comprises a pair of sections 32, 34 which are pivotal about a hinge 36. In an open inverted position, the sections cooperate to form a platform 38 to which is affixed an illustrated story board 40, such as a printed sheet or panel, representative of a story or which forms the support for a story book 42. A carrying handle 39 facilitates portability.

Figure 3:
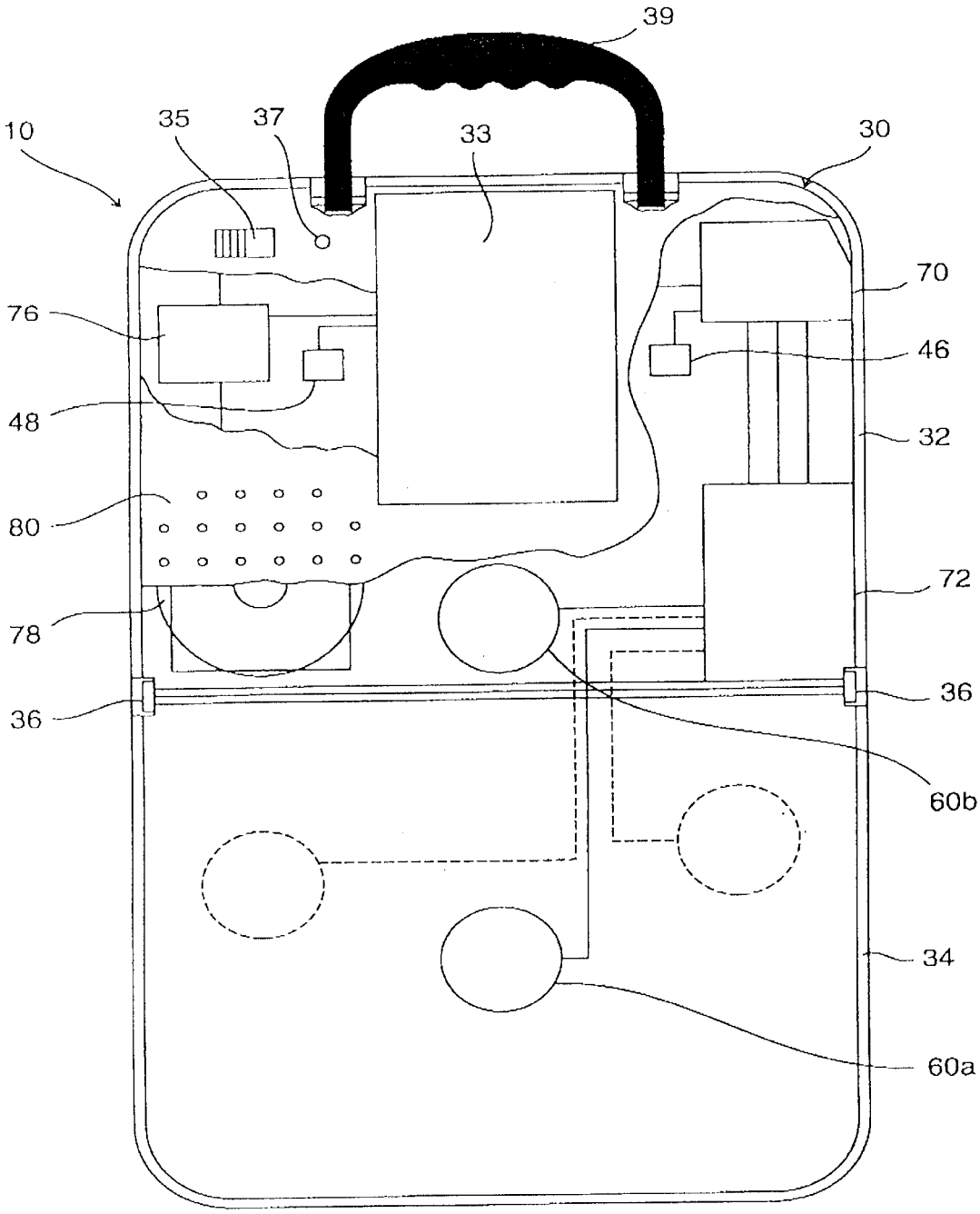
FIG. 3 is a bottom view, partly broken away and partly in schematic, of the electronic story board of FIG. 2.

With reference to FIG. 3, the case section 32 encloses a self-contained battery pack 33 which via an on/off switch 35 provides power for the device. An on/off LED indicator 37 indicates the on/off condition. The case section 32 houses most of the circuitry and electronic components for the electronic story book. The case section 34 functions also as the storage receptacle for the figures 20–24 and the module 26.

The story board 40 and/or pages of book 42 designate a multiplicity of story stations or contact points 44*a*, 44*b*, 44*c* . . . which have a defined relationship with the case. The stations or points may be distinctive circles, squares, shapes, indicia, etc. on the board or page. The board and book also preferably include visual representations, including drawings and text, to aid in "telling" the story and are hereafter individually and/or collectively referred to as story board 50.

The story is electronically communicated in segments by a creative serial questioning by the user. The story segments may be communicated in a non-chronological sequence which is a function of the interactive questioning by the user. The user selects one or more of the figures 20–24 and places each selected figure at a station or contact point 44 on the board 50. The specific figure and corresponding contact point is electronically identified, and an output in the form of a synthesized voice output and/or sound and/or a light output and/or a movement or motion of a portion of the module occurs in response to the selection and placement on the board. The serial placement of the various figures at various selected locations on the board will then, in time, result in the communication of the entire story with the user essentially communicating with the "storyteller" by inquiring through the selection and placement of the various figures. The number of and configuration of figures may vary, and the number and placement of contact points may vary depending on the story. The toy figures are shaped to represent individuals, animals, objects, etc. from the story. The action module 26 may also be constructed to represent a key "prop" or "scene" of the story. The module 26 is mounted to the top of the platform and electrically connected through connectors 46 and 48 to facilitate the multimode "telling" of the story.

With reference to FIGS. 3, 4, 7 and 8, an IC card reader 60 is mounted at the underside of the story board 50 directly below each of the contact points 44*a*, 44*b*, 44*c* . . . and are designated by corresponding identifiers 60*a*, 60*b*, 60*c* . . . . Each of the toy figures 20–24 has a transponder 52 and must also have an IC card 54 which has a unique identification ID code. With references to FIGS. 7 and 8, each reader 60 includes a driver 62 which drives a signal generator 64 to provide an RF signal to a push-pull driver 66. The driver 66 connects with a coil or an inductor 65 which generates an RF field 61 and receives the ID coding signal from the toy figure. The coding signal is amplified by an amplifier 68 whose output is gated by driver 62 and becomes the data signal to the CPU 70. The reader thus functions to provide an RF power source which is supplied to the transponder for powering the toy figure through a non-contact connection. The toy figure then sends an ID coding signal which identifies the specific toy figure to the CPU 70 for processing as described below.

Figure 9:
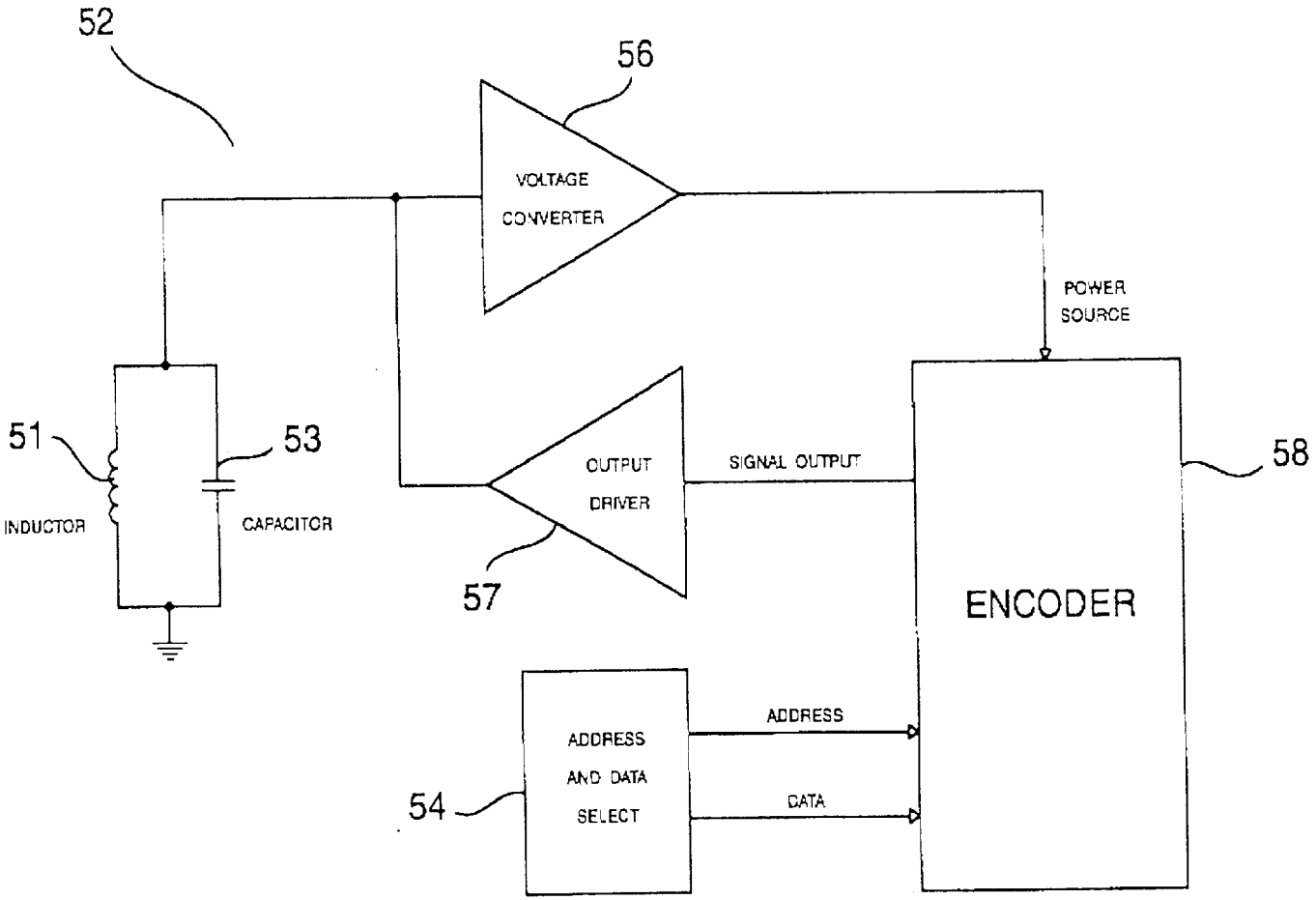
FIG. 9 is a schematic diagram illustrating the circuitry for a toy figure of FIG. 1.

With additional reference to FIG. 9, the transponder 52 includes a coil or an inductor 51 and a capacitor 53 connected in parallel for powering a voltage converter 56 which provides a power source to the encoder 58. An address and data select chip 54 provides an address and data (ID code) to the encoder. The encoder 58 generates the output signal via a driver 57 which communicates the ID of the figure through to the RF field to the reader.

Figure 10:
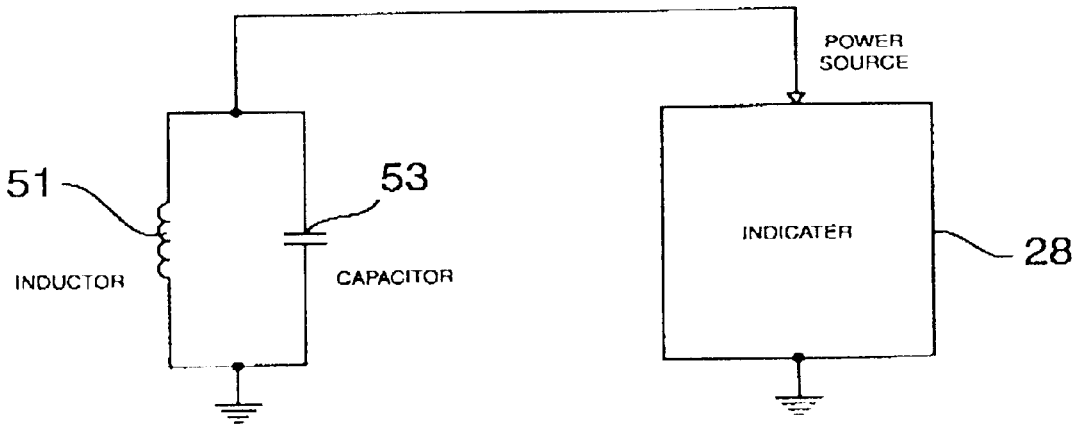
FIG. 10 is a schematic circuit diagram illustrating the circuitry for a passive toy figure for the electronic story board of FIG. 1.

For certain embodiments, such as that illustrated in FIGS. 5 and 10, the RF power source from the reader may also be applied to an indicator or an LED 28 on the toy figure so that, upon application of the RF power source from the reader, the LED 28 is illuminated. Toy figure 23 may optionally be a passive device in which no ID is communicated back to the reader and no story telling output is initiated.

Each of the readers connects with a circuit board 72 which conditions the signals and communicates with the CPU 70. The CPU 70 includes an 80C51 microprocessor and an HCS512 I.D. decoder. Input devices 73, 75 and 77, each of which may be a ROM corresponding to a given toy figure, provide unique data to the CPU 70. The power supply connects with the CPU 70 and a sound circuit 76. The sound circuit 76 includes a W52906 voice synthesizer. The circuit 76 connects with an 0.25 watt speaker 78 which communicates through a panel or shelf 80 attached to the case section 32.

The electronic story board 10 operates by means of an RF object identity system which includes one or more of the readers 60 and one or more figures 20–24. When the power of the system is switched on at switch 35, each of the readers 60 radiates RF radiation to form a field 61 which extends above the story board 50 and intersects the corresponding contact points 44. A selected figure is placed near or on a contact point 44 near the reader so that the transponder 52 will be powered up by the RF power radiated from the reader. The transponder 52 will transmit its own ID code to the reader through the RF field 61.

Figure 7:
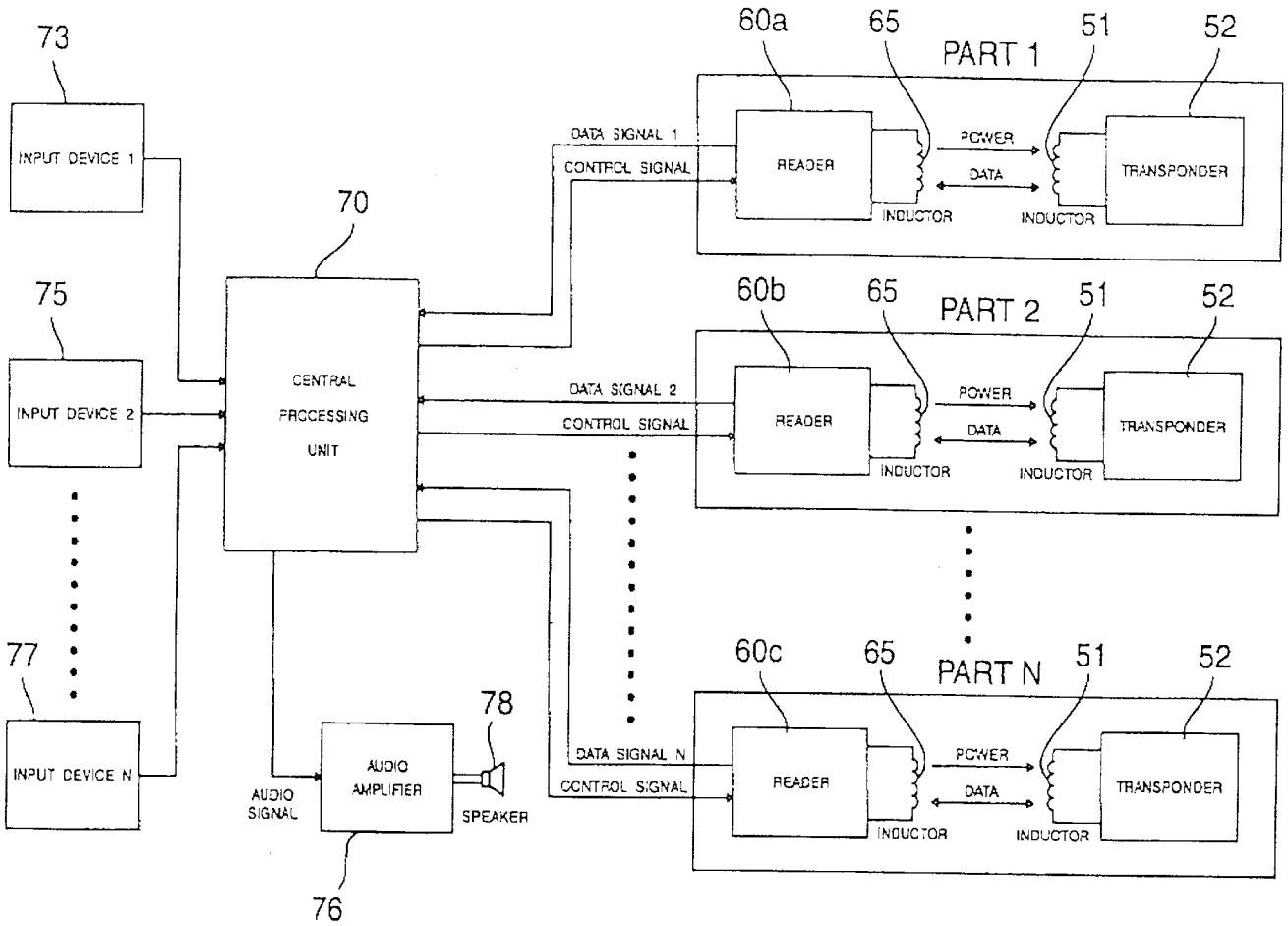
FIG. 7 is a schematic block diagram illustrating the electronic circuitry for the electronic story board of FIG. 1.
Figure 8:
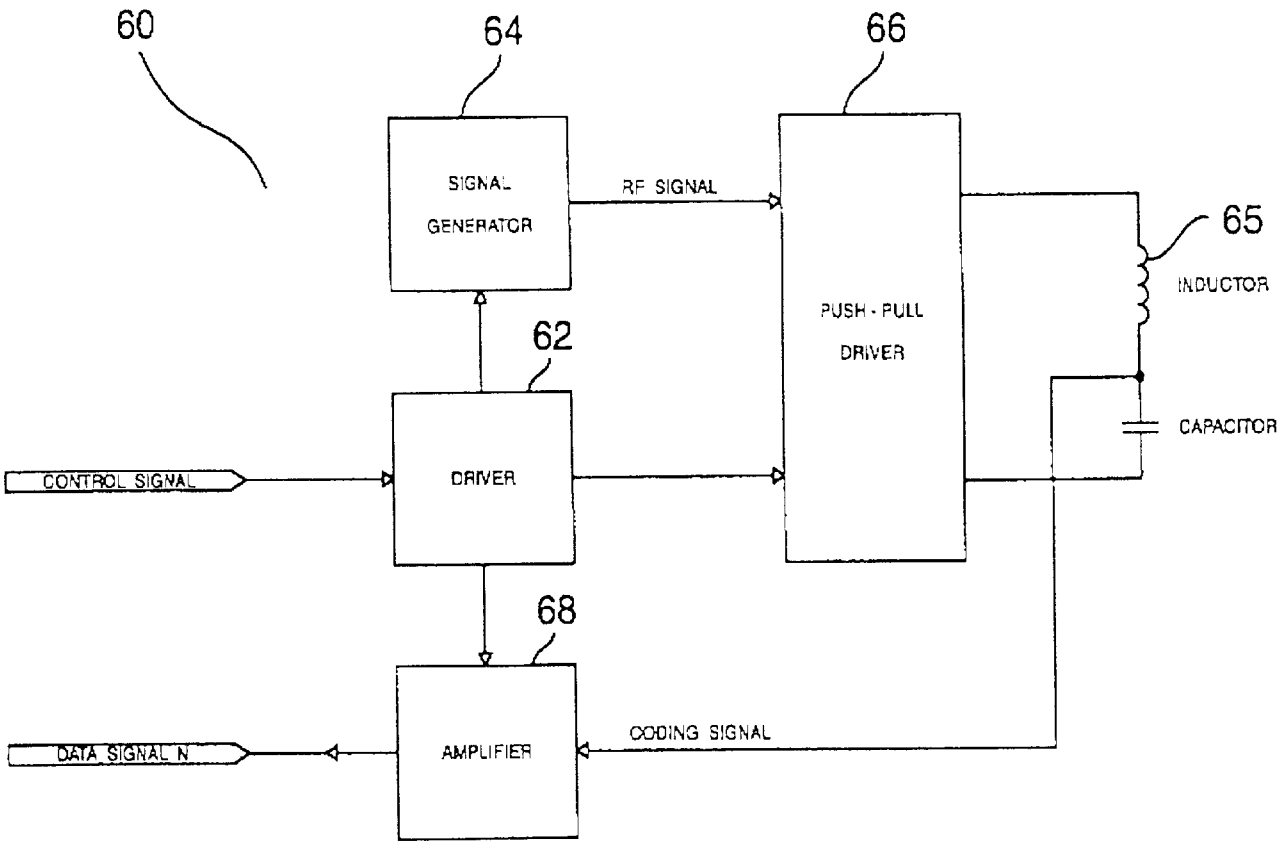
FIG. 8 is a schematic diagram illustrating the circuitry for a reader for the electronic story board of FIG. 1.

With reference to FIGS. 7 and 8, the readers are each controlled by the CPU 70. The CPU 70 generates control signals and polls each reader sequentially as described by flow chart 90. When one of the readers has found a transponder 52 of a toy figure, the CPU 70 continues its polling until all of the readers 60 have been polled. At the termination of the polling sequence, if only one reader found a transponder of a toy figure, the CPU 70 performs an action corresponding to the ID of the transponder found as well as the specific contact point 44, i.e., the specific reader. If more than one reader has a different toy figure, the CPU will perform a different action according to the ID of the first transponder found and the location of its contact point and the ID of the second transponder found and its corresponding contact point and so on until the relative position of all the readers and transponders has been communicated to the CPU. The chart below illustrates representative examples for purposes of explanation.

Chart 1

| Example | Reader | Figure | Action |
|---|---|---|---|
| I | 60a | 20 | A |
| II | 60a | 21 | B |
| III | 60b | 20 | C |
| IV | 60a and 60b | 20, 21 | D |

The CPU is programmed via, for example, input devices 73, 75, 77 . . . to perform the various actions which may correspond to a chapter or part of the story. Action A would be a voice action which is generated through the speaker 78 to tell a narrative concerning toy figure 20 (girl) as suggested by the illustrated environment of contact point 44*a* within the communication field of reader 60*a*. Action B would be a different voice narrative and sound effects relating to toy figure 21 (dog) and conveyed through speaker 78. If toy figure 20 were instead placed at contact point or station 44*b*, Action C would energize lights 27 on the action module 26. If figure 20 were placed at station 44*a* and figure 21 were placed at station 44*b*, Action D would result in the door 29 of the action module 26 opening through the power transmitted and a signal transmitted from the CPU and a corresponding voice action through speaker 78.

It will be appreciated that the story would unfold by, for example, first putting only toy figure 20 on the location of the page or story board; then sequentially selecting a figure 21 and placing that on the book page or story board; and subsequently placing both figures 20 and 21 simultaneously on different contact locations of the story board. Each selection and placement essentially constitutes an inquiry and triggers a corresponding sensory response in terms of one or more sound, voice, light, sight or motion outputs. The story would then be communicated through the various identification and electronic processing among the different figures as well as the different locations on the board wherein the book story would essentially be "told" interactively and in a sequence determined by the user. For example, if Examples I–IV occur in a different order, the story would be told in a different chronological sequence.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An interactive toy comprising:

a platform supporting a story board;

a CPU mounted in fixed relationship to said platform;

an output device communicating with said CPU;

a plurality of readers each communicating with said CPU and comprising RF transmitters defining a communication field and mounted at a fixed position relative to said platform;

a plurality of story figures each comprising a transponder and having a unique code, so that upon placement of at least one story figure within a field, an output is generated by said output device as a function of the code and corresponding reader of each placed figure.

2. The interactive toy of claim 1 wherein said output device includes a speaker.

3. The interactive toy of claim 2 further comprising a circuit for replicating human speech communicating with said speaker.

4. The interactive toy of claim 1 wherein said output device is a light.

5. The interactive toy of claim 1 wherein said story figures comprise one or more figures selected from the group consisting of a person, an animal or an object.

6. The interactive toy of claim 1 wherein said output device further comprises a module mounted to said platform and projecting generally above said story board.

7. The interactive toy of claim 1 wherein said story board further comprises means defining a contact point located generally above said readers.

8. The interactive toy of claim 1 wherein said platform is hinged and is foldable to form an enclosure.

9. The interactive toy of claim 1 wherein said story board comprises a page of a book.

10. The interactive toy of claim 1 further comprising a case having a pair of sections which are hinged and each section having a panel which cooperates to form said platform.

11. The interactive toy of claim 1 wherein said CPU sequentially polls each said reader and identifies any story figure disposed in said communication field of said reader.

12. An interactive toy comprising:

a case;

a plurality of readers each defining an RF communication field at selected locations relative to said case;

board means for defining a story board having a plurality of story stations corresponding to said locations;

a CPU disposed in said case and communicating with said readers;

story output means communicating with said CPU for generating an audible output;

a plurality of story figures each comprising a transponder and having a unique code, so that upon placement of at least one story figure at at least one station, an output is generated as a function of the code and corresponding station of each placed figure.

13. The interactive toy of claim 12 wherein said output means further comprises a speaker and a circuit for replicating human speech communicating with said speaker.

14. The interactive toy of claim 12 wherein said output means further comprises means for illuminating at least one light.

15. The interactive toy of claim 12 wherein said story figures comprise one or more figures selected from the group consisting of a person, an animal or an object.

16. The interactive toy of claim 12 wherein said output device comprises a module mounted to said case and projecting generally above said story board.

17. The interactive toy of claim 12 wherein said story board comprises a page of a book.

18. The interactive toy of claim 12 wherein said CPU sequentially polls each said reader and identifies any story figure disposed at a corresponding station of said reader.

19. The interactive toy of claim 12 wherein said case comprises a pair of hinged sections each having a panel and said board means comprises an illustrated sheet affixed to said panels.

20. The interactive toy of claim 19 wherein when said case is closed, said illustrated sheet is exteriorly visible.

* * * * *